US006755061B2

(12) United States Patent
Herzenberg

(10) Patent No.: US 6,755,061 B2
(45) Date of Patent: Jun. 29, 2004

(54) KEY SET CONFIGURED TO BE HELD IN A COMPACT ARRANGEMENT

(76) Inventor: Jacob Sholom Herzenberg, 20010 Sawgrass La., Apt. 4304, Boca Raton, FL (US) 33434-3337

( * ) Notice: Subject to any disclaimer, the term of this patent is extended or adjusted under 35 U.S.C. 154(b) by 0 days.

(21) Appl. No.: 10/253,325

(22) Filed: Sep. 24, 2002

(65) Prior Publication Data

US 2004/0055347 A1 Mar. 25, 2004

(51) Int. Cl.[7] ..... E05B 19/04

(52) U.S. Cl. ..... 70/408; 70/456 R; 70/459; 70/401

(58) Field of Search ..... 70/408, 409, 456 R, 70/459, 460, 395, 400, 401, 407

(56) References Cited

U.S. PATENT DOCUMENTS 976,515 A * 11/1910 Soley ..... 70/307
3,147,609 A 9/1964 Ryan
3,457,746 A 7/1969 Glassman
4,305,267 A * 12/1981 Nish et al. ..... 70/395
4,403,487 A * 9/1983 Marty ..... 70/408
4,796,750 A 1/1989 Inghram
4,946,030 A 8/1990 Guridi et al.
4,959,983 A * 10/1990 Hsu ..... 70/456 R
5,355,702 A * 10/1994 Escribens ..... 70/395
5,720,211 A 2/1998 Cahan
5,887,468 A 3/1999 Hasan
6,035,679 A * 3/2000 Meroni ..... 70/396
6,132,058 A * 10/2000 Kuo ..... 362/116
6,386,006 B1 * 5/2002 DeWalch ..... 70/34

* cited by examiner

*Primary Examiner*—Lynne H. Browne
*Assistant Examiner*—Michael J. Kyle
(74) *Attorney, Agent, or Firm*—Ronald V. Davidge

(57) ABSTRACT

The individual keys in a set of keys are configured to fit together in a compact arrangement, with the heads of the keys being in alignment with one another in one direction and stacked against one another in another direction, and with the shanks extending essentially in alignment with one another but spaced apart along the heads. A set of keys may be formed using two outer key configurations or by using the two outer key configurations, together with a central key configuration. One or more of such sets of keys may be stored in a holder including pockets for their storage.

18 Claims, 3 Drawing Sheets

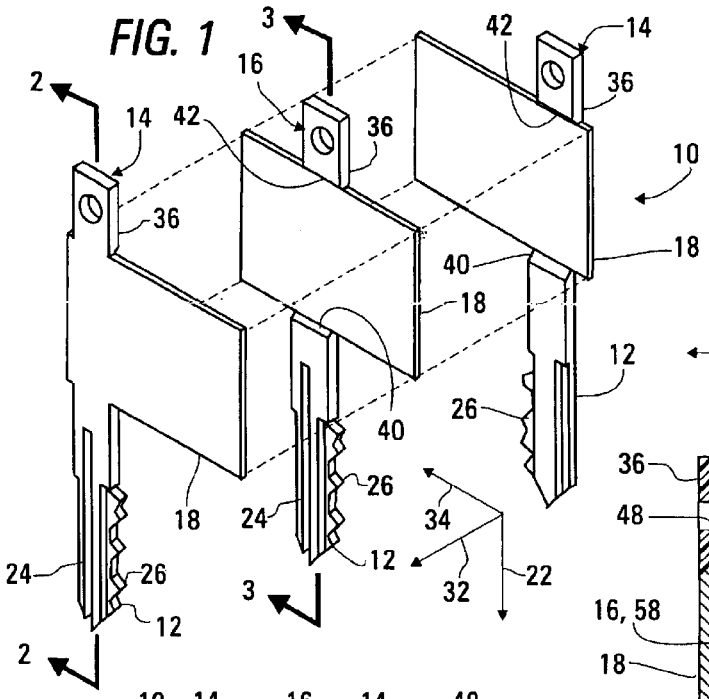
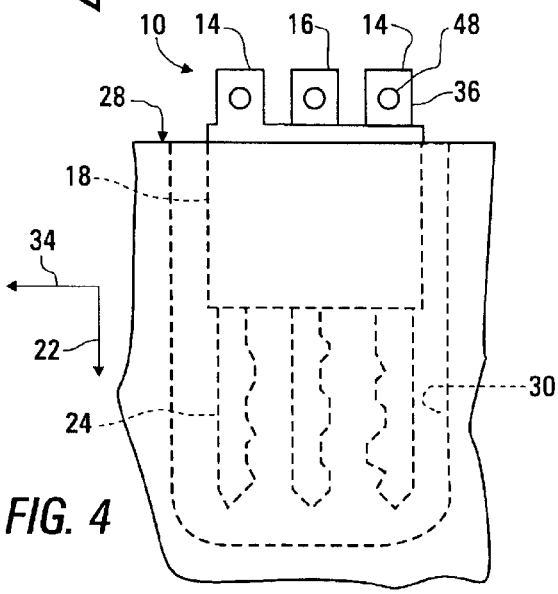
FIG. 4
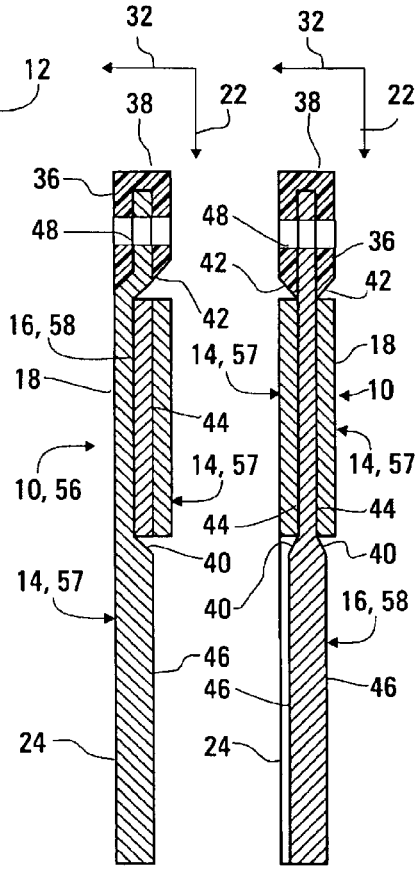
FIG. 2
FIG. 3

KEY SET CONFIGURED TO BE HELD IN A COMPACT ARRANGEMENT

BACKGROUND OF THE INVENTION

1. Field of the Invention

This invention relates to keys for unlocking mechanical locks, and, more particularly, to a set of such keys configured to be held within a holder in a compact arrangement.

2. Background Information

The patent literature includes a number of examples of a key carrier holding the shank portions of a number of keys in a manner allowing an individual shank to be moved from a stored position within the holder to an operating position, extending outward from the holder, in which the key can be used to unlock a mechanical lock, with the holder being used as a handle to facilitate turning the key shank in the lock. In such devices, an individual key shank is slid or pivoted outward, as described, for example, in U.S. Pat. Nos. 3,147,609, 3,457,746, 5,720,211, and 5,887,468. Of these patents, U.S. Pat. No. 5,720,211 additionally describes an apparatus and method for making key shanks to be held in such a holder by removing the head portions of conventional keys.

One problem with carriers having key shanks movably attached therein arises from the fact that people change individual keys within the group of keys, as they move from one residence to another, as they replace an automobile, etc. Thus, what is needed is a compact method for carrying keys that can be readily separated for the replacement of individual keys as well as for the use of a particular key to unlock a lock.

A number of other patents describe holders for holding conventional keys in pockets formed in a planar structure. For example, U.S. Pat. No. 4,796,750 describes such a structure forming a wallet that can be folded about its center, with pickets for conventional keys on the outside, and with a currency pocket formed between overlaying layers. U.S. Pat. No. 4,946,030 describes an emergency key holder card, the size and shape of a credit card, in which keys and other incidentals, such as toothpicks, are stored. The keys may be separably retained as conventional keys within corresponding apertures of the card, or may be separably and hingedly attached to the emergency key holder card so that they may pivot into and out of the plane of the card. What is needed is a key set and holder having an ability to hold a substantially larger number of keys in a small volume.

U.S. Pat. No. 5,720,211 additionally describes a carrying case for holding a number of key shanks from which the heads have been cut away. One of such key shanks may be placed in a slot within a separate head for use to open a lock. What is needed is a compact method for storing keys that are ready to use to open a lock when they are removed from a holder.

SUMMARY OF THE INVENTION

According to a first aspect of the invention, apparatus is provided for unlocking a number of locks. The apparatus includes a set of keys, each of which includes a head and a shank, having an edge formed to unlock a lock within the number of locks, extending from the head in a first direction. Within each of the keys, the head extends in a second direction, perpendicular to the first direction, through a thickness of the head, and in a third direction, perpendicular to the first and second directions, through a width of the head, and the width of the head is substantially greater than the thickness of the head. The keys are configured to fit together in a compact arrangement, with the heads stacked against one another in the second direction and in alignment with one another in the first and third directions, and with the shanks extending in the first direction, in alignment in the second direction, and spaced apart in the third direction.

Each of the keys may also include a tab, extending from the head opposite the first direction, aligned in the third direction with the shank of the key. When the keys are placed In the compact arrangement these tabs extend in alignment in the second direction, being spaced apart in the third direction.

Preferably, within two keys of the set of keys, the shank is disposed in the third direction from a center of the head of the key, and the head is disposed in the second direction from a center of the shank. Additionally, within these two keys, the head preferably includes an interface surface facing opposite the second direction, the shank includes an interface surface facing opposite the second direction, and the key blank includes a first transition section having an interface surface extending at an acute angle between the interface surfaces of the head and the shank.

The set of keys may also include a single key having a shank aligned in the second and third directions with a center of its head, with a thickness of the shank of the single key in the second direction being substantially greater than a thickness of the head of the single key, and with the single key including a transition section, extending between the head and the shank, gradually varying in thickness between the thickness of the shank and the thickness of the head.

In accordance with the invention the keys in a set of keys are configured to fit together in a compact arrangement, with the heads of the keys being in alignment with one another in two directions and stacked against one another in another direction, and with the shanks extending essentially in alignment with one another but spaced apart along the heads.

According to another aspect of the invention, a key blank is provided for cutting to form a key within such a set of keys.

According to yet another aspect of the invention, a method is provided for making such a set of keys to form copies of a number of prototype keys.

BRIEF DESCRIPTION OF THE DRAWINGS

FIG. 1 is an exploded perspective view of a set of three keys made in accordance with a first embodiment of the invention;

FIG. 2 is a cross-sectional elevation of the set of keys of FIG. 1, taken through the shank of an outer key, as indicated by section lines 1—1, therein;

FIG. 3 is a cross-sectional elevation of the set of keys of FIG. 1, taken through the shank of a central key, as indicated by section lines 3—3, therein;

FIG. 4 is an elevation of the set of keys of FIG. 1 within a pocket of a key holder;

DETAILED DESCRIPTION OF THE INVENTION

Figure 5:
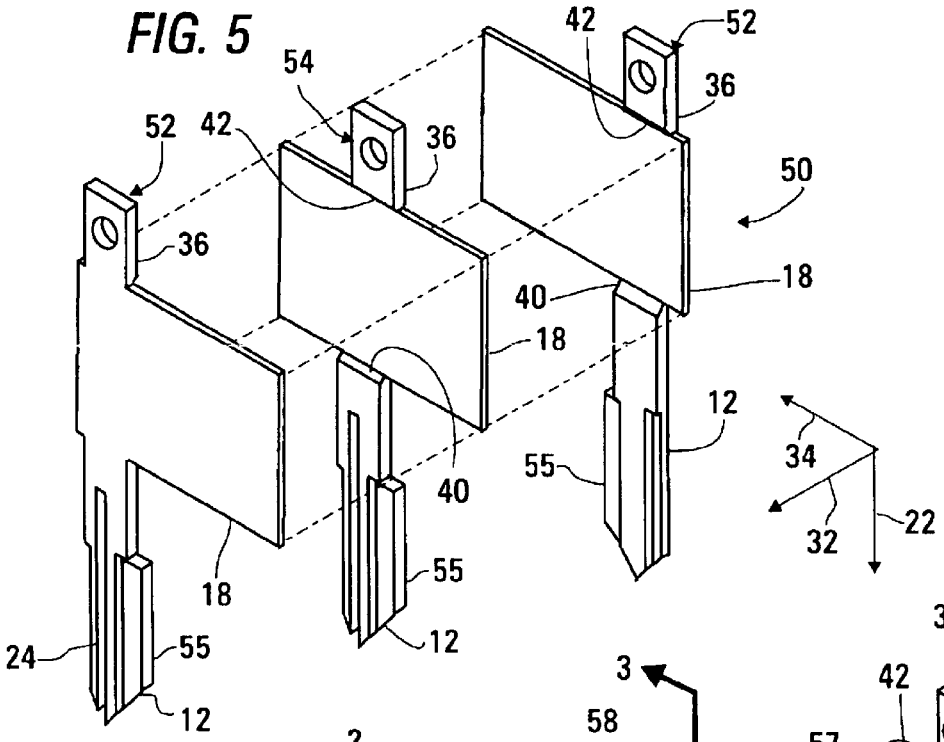
FIG. 5 is an exploded perspective view of a set of blanks for making the set of keys of FIG. 1.

FIGS. 1–3 are views of a key set 10 manufactured in accordance with a first embodiment of the invention, with keys in the key set 10 being placed together in a compact configuration so that three keys occupy a space otherwise used to store a single conventional key. FIG. 1 is an exploded perspective view of the key set 10, while FIGS. 2 and 3 are cross-sectional elevations thereof, with FIG. 2 being taken through the shank 12 of an outer key 14, as shown in section lines 2—2 in FIG. 1, and with FIG. 3 being taken through the shank 12 of a central key 16. Unlike the keys within various types of holders described in the prior art, the keys in key set 10 are not fastened together, and can be used individually to unlock locks. Nevertheless, the keys in key set 10 can be held together in their compact arrangement within a pocket in a holder.

The key set 10 includes three keys, two of which are outer keys 14, and one of which is a central key 16. Each of the keys 14, 16 includes a shank 12, a head 18, and a tab 20, with the shank 12 extending from the head 18 in the first direction of arrow 22, and with the tab 20 extending from the head 19 opposite the direction of this arrow 22. Each of the shanks 12 includes conventional grooves 24 for guiding the shank 12 into a type of lock, and conventional ridges 26 for unlocking a particular lock.

FIG. 4 is an elevation of the key set 10 as held in the compact arrangement within a of key holder 28 having a pocket 30 holding in which the keys 14, 16 are configured to fit by reducing the thickness, in the second direction of arrow 32 of each of the heads 18 and by causing the relatively thick shanks 24 to be spaced apart in this arrangement in the third direction of arrow 34. Preferably, each of the keys 14, 16 also includes a tab 36, which is aligned in the third direction of arrow 34 with the shank 12 of the particular key 14, 16. Therefore, when the key set 10 is held in its compact arrangement with the shanks 12 and heads 18 of the keys 14, 16 in a pocket of a key carrier, the tabs 36 extend outward from the pocket of the key carrier to be used to identify a particular key 14, 16 and to serve as a handle so that the particular key 14, 16 can be removed from the pocket 30 to be used to open a lock. The process of identification is facilitated by color-coding the tabs 36. For example, as shown particularly in FIGS. 2 and 3, each tab 36 may be fitted with a plastic cover 38 having a different color.

For example, the thickness of the head 18 in the second direction of arrow 32 is 0.8 mm (1/32 inch), with the three heads 18 having a combined thickness of 2.4 mm (3/32 inch), and with the shanks 12 and tabs 36 also having a thickness of about 2.4 mm (3/32 inch).

Preferably, the keys 14, 16 are further configured so that an individual key 14, 16 can be drawn from the key set 10 in a direction opposite the first direction of arrow 22 and returned to the key set 10 in the first direction of arrow 22. Thus, each key 14, 16 includes a first transition section 40, extending between its head 18 and its shank 24, and a second transition section 42, extending between its head 18 and its tab 36. These transition sections 40, 42 provide smooth changes in the thickness, in the second direction of arrow 32, of each of the individual keys 14, 16, with obliquely inclined surfaces extending along the transition sections 40, 42 between adjacent interface surfaces 44 of the heads 18 and interface surfaces 46 of the shanks 24. These interface surfaces 44, 46 are the surfaces that rub against an adjacent key 14, 16 as a particular key 14, 16 is drawn from the key set 10 or replaced therein.

While the invention provides the keys 14, 16 with an ability to be stored in such an compact manner, when an individual key 14, 16 is separated from the others, it can be used in the manner to unlock a mechanical lock and to be handled in a conventional manner. A hole 48 extending through the tab 36 can be used to allow the key to be placed on a hook or peg, so that car keys made in accordance with the invention can be stored on a conventional key storage board in a valet parking operation. Additionally, the holes 48 may be used, with a flexible connection, such as a wire or string, to join two keys to be used together, such as a glove compartment key and an ignition key for an automobile.

FIG. 5 is an exploded perspective view of a set of key blanks 50 for making the key set 10 in accordance with the invention. The set of key blanks 50 includes two outer key blanks 52 for making the outer key 14 and a single central key blank 54 for making the central key 16. The key blanks 52, 54 preferably include the various elements described above in reference to FIGS. 1–3, such as heads 18, shanks 24, tabs 26, and transition sections 40, 42. The key blanks 52, 54 do not include the patterns of ridges 26 for unlocking a mechanical lock, but rather include material 55 sufficient to allow these ridges 26 to be cut by conventional key cutting techniques. Additionally, the plastic covers 38 may be supplied separately from the key blanks 52, 54 so that these covers 38 can be used to create a particular color-coding scheme for the key set 10, in spite of the particular requirements for different types of key blanks 52, 54.

In this preferred version of the first embodiment, each key made with one of the outer key blanks 52 can be used on either side of a key made from the central key blank 54. Thus, only two types of key blanks, outer and central, are needed to provide for the features of this version of the invention. Of course, many different key blanks are needed to be able to make keys for the various types of conventional locks in use today.

Figure 6:
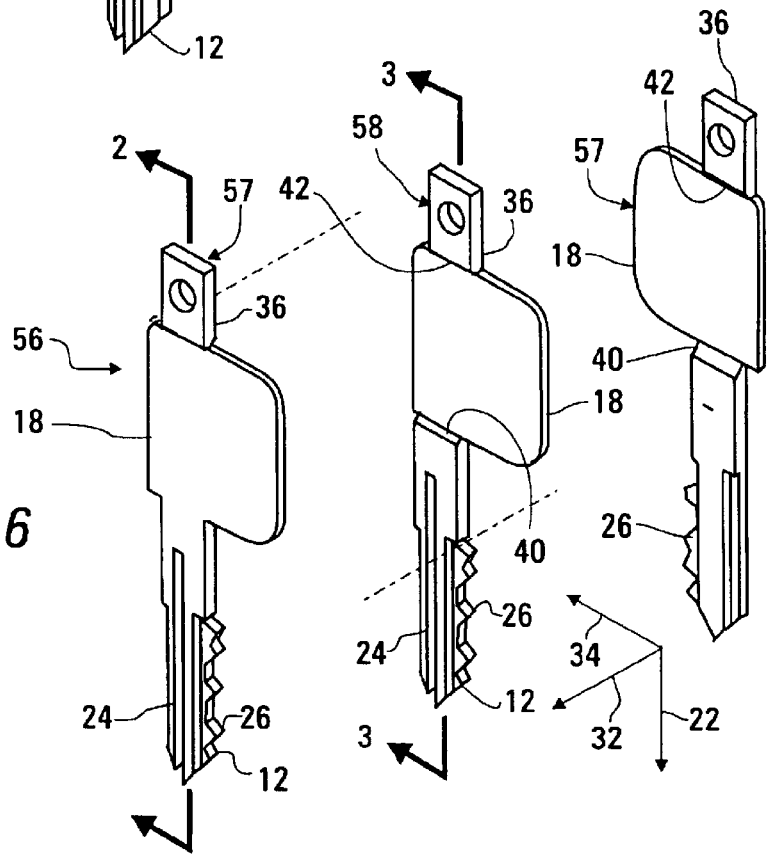
FIG. 6 is an exploded perspective view of a set of three keys made in accordance with a second embodiment of the invention.

FIG. 6 is an exploded perspective view of a set 59 of three keys made in accordance with a second embodiment of the invention. This key set 59 is configured so that the outer keys 57 can be cut from the same blank, and so that the blank from which the central key 58 is cut differs from the blank used to form the outer keys 57 only in a machining operation used to decrease the thickness of the keys 57, 58 in the region of their heads 18 and to form the transition sections 40, 42. This is accomplished by reducing the width of the heads 18 in the third direction of arrow 34, so that the profiles of the heads 18 of the outer keys 57 and the central key 58 are identical when viewed in the second direction of arrow 32. Again, the compact configuration is formed by reversing the orientation of one of the outer keys 57. The key sets 10, 59 are identical when viewed as indicated by section lines 2—2 and 3—3, so FIGS. 2 and 3 also provide cross-sectional elevations of the key set 59.

While the heads 18 of the individual keys 14, 16 in the key set 10 of the first embodiment are aligned within their compact arrangement in the first direction of arrow 22 and additionally in the third direction of arrow 34, the heads 18 of the individual keys 57, 58 in the key set 56 of the second embodiment are aligned within their compact arrangement only in the first direction of arrow 22.

Figure 7:
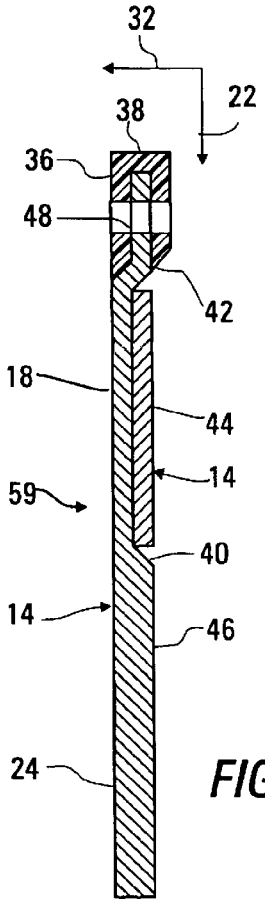
FIG. 7 is a cross-sectional elevation of a set of two keys made in accordance with a third embodiment of the invention.

FIG. 7 is a cross-sectional view of a key set 59 made in accordance with a third embodiment of the invention to include a pair of outer keys 14, without the central key 16.

While the first and second embodiments of the invention, discussed above in reference to FIG. 1, has an advantage of making a more efficient use of a space reserved for storing keys, with three keys being stored in a space otherwise used for storing one conventional key, the third embodiment of FIG. 7 still stores two keys in the space otherwise used for storing one conventional key and additionally has an advantage of only requiring a single type of blank to provide the features of the invention.

As shown in FIG. 7, the key set 59 of the third embodiment can be made using the same outer keys 14 that are used in the key set 10 of the first embodiment, providing an advantage of flexibility in that keys made for the key set 59 may be additionally used in key sets 10, by simply adding a central key 16. Alternatively, the thickness, in the direction of arrow 32 of the heads 18 of outer keys 14 to be used in the key sets 59 may be increased into a space that would otherwise be reserved for the head 18 of a central key 16.

Figure 8:
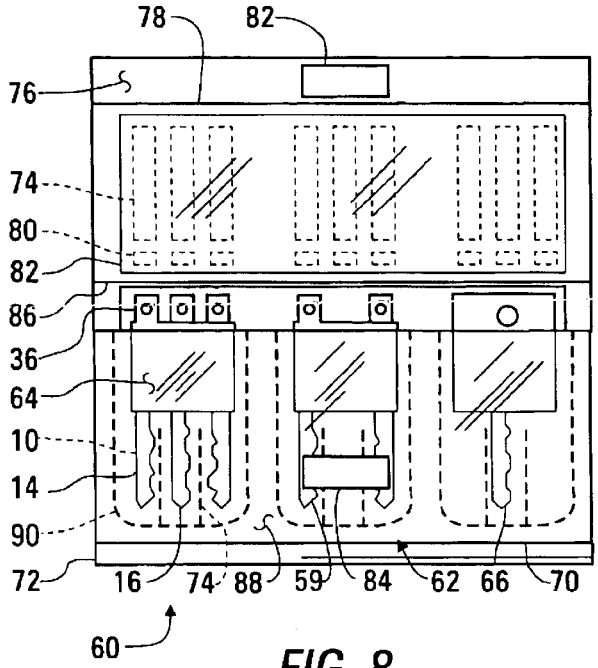
FIG. 8 is a front elevation of a key holder made in accordance with the invention to hold sets of keys of FIGS. 1, 5, and 6.
Figure 10:
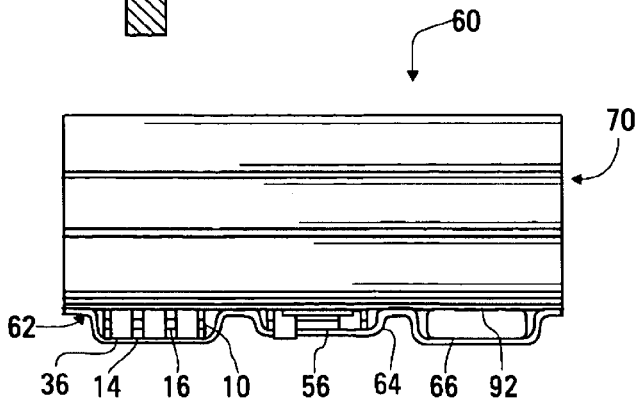
FIG. 10 is a plan view of the key holder of FIG. 8.
Figure 9:
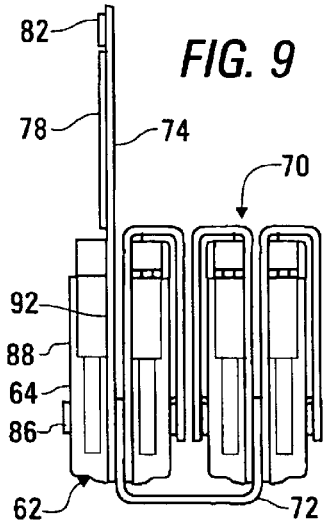
FIG. 9 is an end view of the key holder of FIG. 8.

FIGS. 8–10 are views of a key set holder 60 made in accordance with the invention, with FIG. 8 being a front elevation thereof, with FIG. 9 being an end view thereof, and with FIG. 10 being a top view thereof. The key set holder 60 includes one or more sections 62, each of which a number of individual pockets 64 for holding key sets 10, having three keys 14, 16, key sets 56 having three keys 57, 58 (shown in FIG. 6), and key sets 59 having two keys 14. The pockets 64 may also be used to hold conventional keys 66, such as automobile keys that cannot be copied to form keys within a key set 10, 57, 59, because the conventional keys 66 include anti-theft computer chips.

In the example of these figures, each of the four sections 62 holds three key sets 10, 56, 59 so that up to twelve key sets can be held, providing space for up to thirty-six individual keys 14, 16, 57, 58. The four sections 62 are arranged back-to-back in two pairs 70 of sections 62, which are connected with one another by means of a flexible member 72. Each of the sections 62 includes a flap 74 that can be folded downward, into a closed position, to cover the pockets 64 in the particular section 62 and the keys contained therein. In the figures, a first flap 74 is shown in its open position, while the remaining flaps 74 are shown in their closed positions.

Preferably, the flap 74 includes, extending along its internal side 76, a clear pocket 78 holding a card 80, providing information useful in identifying keys held within the holder 60 and additionally facilitating the return of keys according to a predetermined after their use. For example, the card 80 includes, for each location in which an individual key 14, 16, 57, 58 can be stored within the section 62, a first area 82 that can be colored to match the color of the tab 36 of the adjacent key and a second area 84 in which the purpose of the adjacent key can be written. The pocket 78 is open along an edge 86, allowing the removal of the card 80 and its subsequent reinsertion after the addition of markings identifying the adjacent keys.

The flap 74 preferably also includes a first fastener pad 82 for holding the flap 74 in its closed position by removable attachment to a second fastener pad 84 attached to a cover 88 forming the pockets 64 of the section 62. For example, the pads 82, 84 may be portions of a loop and hook type of fastener system sold under the trademark VELCRO®.

Along the cover 88, the dashed lines 90 in FIG. 8 represent lines of attachment within each between the cover 88 forming the pockets 64 and an inner layer 92 of the section 62. For example, if the layers 88, 92 are composed of textile or leather-like materials, the dashed lines 90 represent lines of stitching. If the layers 88, 92 are composed of flexible thermoplastic materials, the dashed lines 90 may represent lines of adhesive attachment or of plastic welding. Furthermore, the layers 88, 92 may be composed of opaque materials or of transparent materials. Additionally, the individual pockets for the key sets 10, 59, may be partly divided to form separate channels 94 for holding portions of the shanks 12. Alternately, the individual pockets may not have such divisions into channels, as shown in the example of FIG. 4.

It is understood that the holder 60 can be made with many variations within the scope and spirit of the invention. For example, the holder 60 can be made with only one section 62, with a pair 70 of sections 62 arranged back to back, or with additional pairs 70 of sections 62 attached by additional flexible members 72. Each section 72 may have only a single pocket 64 for holding a single key set 10, 56, 59 or many more pockets 64 than the three pockets 64 shown in the example of the figures. The sections 62 may be made in an elongated form and cut to length to have a desired number of pockets 64.

The key sets 10, 56, 59 and holder 60 can either be used as a primary source of keys required by an individual for daily use or as a source of back-up or reserve keys for use in case the primary source of keys cannot be found.

The key sets 10, 56, 59 are preferably made by a key maker after receiving a set of prototype keys to be copied for an individual. For making conventional keys, a key maker needs to have access to a number of different types of conventional key blanks, so that copies of may different types of keys from different manufacturers can be made. For making the key sets 10, 56, 59, the key maker must have access to a number of blanks for different types of keys in the form of outer key blanks 52 and central key blanks 54, or in the form of the key blanks to form keys 57, 58. If only the two-key sets 59 are to be made, only blanks for different types of keys in the form of outer key blanks 52 are needed. Preferably, if key sets 10 are to be made, two outer key blanks 52 are used for each central key blank 54. If the number of keys to be copied is not a multiple of three, additional outer key blanks 52 are used, so that a resulting two-key set 59 can be subsequently converted to a three-key set 10 by the addition of a central key 16, or so that a resulting single outer key 14 can be subsequently converted to a two-key set 10.

The key-copying process for generating the pattern of ridges 26 to open a particular lock is conventional and well known to those skilled in the art of making keys, with both the prototype key to be copied and the blank 52, 54 or a corresponding blank for the key 57, 58 being clamped in a conventional key cutting machine, so that the pattern of ridges 26 is cut into the blank as the corresponding pattern of ridges on the prototype key is moved along a post.

After the key sets 10, 56, 59 are made in this way, they may be placed in a holder 60 before presentation to the customer.

While the invention has been described in terms of three-key sets 10, 56 and two-key sets 59, it is understood that key sets having greater numbers of individual keys may be made without departing from the spirit and scope of the invention.

In accordance with the invention the keys 14, 16, 57, 58 in a set of keys 10, 56, 59 are configured to fit together in a compact arrangement, with the heads 18 of the keys stacked against one another in the second direction of arrow 22, and with the shanks extending in the first direction of arrow 22, in alignment in the second direction of arrow 32, and spaced apart in the third direction of arrow 34. With the heads stacked in this way, a compact storage configuration is achieved while maintaining a sufficient area in the heads 18 to allow these heads 18 to serve as handles when the keys 14, 16 is turned to open locks.

Furthermore, while the invention has been described in terms of its preferred versions or embodiments with some degree of particularity, it is understood that this description has only been provided as examples of the invention, and that numerous changes can be made without departing from the spirit and scope of the invention.

What is claimed is:

1. Apparatus for unlocking a plurality of locks, comprising a set of keys, wherein:

each of said keys includes a head and a shank, having an edge formed to unlock a lock within said plurality of locks, extending from said head in a first direction, within each of said keys, said head extends in a second direction, perpendicular to said first direction, through a thickness of said head, and in a third direction, perpendicular to said first and second directions, through a width of said head, and said width of said head is substantially greater than said thickness of said head, said keys are configured to fit together in a compact arrangement, with said heads stacked against one another in said second direction and in alignment with one another in said first direction, and with said shanks extending in said first direction, in alignment in said second direction, and spaced apart in said third direction.

2. The apparatus of claim 1, wherein said keys are additionally configured to fit together in said compact arrangement with said heads in alignment in said third direction.

3. The apparatus of claim 1, wherein profiles of heads of said keys as viewed in said second direction are identical.

4. The apparatus of claim 1, wherein each of said keys includes a tab, extending from said head opposite said first direction, aligned in said third direction with said shank of said key, and with said keys in said compact arrangement said tabs of said keys extend in alignment in said second direction, and spaced apart in said third direction.

5. The apparatus of claim 4, wherein each of said tabs includes a hole extending through said tab in said second direction.

6. The apparatus of claim 4, wherein each of said tabs is colored differently.

7. The apparatus of claim 1, wherein, within two keys in said set of keys, said shank is disposed in said third direction from a center of said head of said key, and said head is disposed in said second direction from a center of said shank.

8. The apparatus of claim 7, wherein, within said two keys in said set of keys, said head includes an interface surface facing opposite said second direction, said shank includes an interface surface facing opposite said second direction, said key blank includes a first transition section having an interface surface extending at an acute angle between said interface surfaces of said head and said shank.

9. The apparatus of claim 8, wherein, within a single key within said set of keys, said shank is aligned in said second and third directions with a center of said head.

10. The apparatus of claim 9, wherein a thickness of said shank of said single key in said second direction is substantially greater than a thickness of said head of said single key, and said single key includes a transition section, extending between said head and said shank, gradually varying in thickness between said thickness of said shank and said thickness of said head.

11. The apparatus of claim 1, additionally comprising a holder including a pocket for holding said set of keys in said compact arrangement.

12. The apparatus of claim 11, wherein said pocket includes a single distal portion of sufficient width to hold said shanks of said keys, spaced apart in said third direction.

13. The apparatus of claim 11, wherein said pocket is divided into a number of channels to hold said shanks of said keys, spaced apart in said third direction.

14. The apparatus of claim 11, wherein said holder additionally includes:

a plurality of additional pockets for holding a plurality of additional sets of keys in said compact arrangement;

a flap extending over said pockets in a closed position and movable into an open position extending away from said pockets; and a card held within said flap to extend adjacent said pockets with said flap in said open position, wherein said card includes positions for indicia describing keys within said pockets.

15. The apparatus of claim 11, wherein said holder includes a plurality of sections, wherein said pocket is included in a section within said plurality of sections, and wherein each section within said plurality of sections includes:

a plurality of pockets for holding a plurality of sets of keys in said compact arrangement;

a flap extending over said pockets in a closed position and movable into an open position extending away from said pockets; and a card held within said flap to extend adjacent said pockets with said flap in said open position, wherein said card includes positions for indicia describing keys within said pockets.

16. The apparatus of claim 11, wherein each of said keys includes a tab, extending from said head opposite said first direction, aligned in said third direction with said shank of said key, with said keys in said compact arrangement, said tabs of said keys extend in alignment in said second direction, and spaced apart in said third direction, and said pocket holds said heads and said shanks of said keys in said compact arrangement with said tabs of said keys extending outward from said pocket.

17. A method for making a set of keys forming copies of prototype keys within a plurality of prototype keys, wherein said method comprises:

receiving said plurality of prototype keys;

choosing a key blank, from a plurality of key blanks, to form a set of key blanks, wherein each of said key blanks includes a head and a shank, having an edge formed to unlock a lock within said plurality of locks, extending from said head in a first direction, within each of said key blanks, said head extends in a second direction, perpendicular to said first direction, through a thickness of said head, and in a third direction, perpendicular to said first and second directions, through a width of said head, and said width of said head is substantially greater than said thickness of said head, said key blanks in said set of key blanks are configured to fit together in a compact arrangement, with said heads stacked against one another in said second direction and in alignment with one another in said first direction, and with said shanks extending in said first direction, in alignment in said second direction, and spaced apart in said third direction, each of said key blanks includes a shank corresponding to a shank of a different prototype key within said plurality of prototype keys, and a key blank is chosen for each prototype key within said plurality of prototype keys; and grinding an edge of said shank of each key blank in said plurality of key blanks to match an edge of a corresponding shank of a key in said plurality of prototype keys.

18. The method of claim 17, additionally comprising placing said set of keys in a pocket of a holder holding said compact arrangement.

* * * * *